US009333386B2

(12) United States Patent
Alazet

(10) Patent No.: US 9,333,386 B2
(45) Date of Patent: May 10, 2016

(54) PHYSICAL EXERCISE DEVICE

(76) Inventor: Jean Alazet, Paris (FR)

( * ) Notice: Subject to any disclaimer, the term of this patent is extended or adjusted under 35 U.S.C. 154(b) by 63 days.

(21) Appl. No.: 13/979,793

(22) PCT Filed: Feb. 10, 2012

(86) PCT No.: PCT/FR2012/000050

§ 371 (c)(1),
(2), (4) Date: Sep. 2, 2013

(87) PCT Pub. No.: WO2012/110714

PCT Pub. Date: Aug. 23, 2012

(65) Prior Publication Data

US 2014/0315697 A1 Oct. 23, 2014

(30) Foreign Application Priority Data

Feb. 14, 2011 (FR) ..... 11 00434
Feb. 7, 2012 (FR) ..... 12 00356

(51) Int. Cl.
*A63B 71/00* (2006.01)
*A63B 21/02* (2006.01)
(Continued)

(52) U.S. Cl.
CPC ..... *A63B 21/0557* (2013.01); *A63B 21/0552* (2013.01); *A63B 21/169* (2015.10); *A63B 21/4001* (2015.10); *A63B 21/4009* (2015.10); *A63B 21/4025* (2015.10); *A63B 69/0059* (2013.01)

(58) Field of Classification Search
CPC .. A63B 21/02; A63B 21/055; A63B 21/0552; A63B 21/0555; A63B 21/0557; A63B 21/1403; A63B 21/1419; A63B 21/1449; A63B 69/0059; A63B 2021/169
USPC ..... 482/44–50, 92, 121–122, 126–128
See application file for complete search history.

(56) References Cited

U.S. PATENT DOCUMENTS 3,994,289 A * 11/1976 Thomas ..... A61H 39/04 601/120
4,010,948 A 3/1977 Deluty
4,176,835 A * 12/1979 Aziz ..... A63B 23/0211 482/140

(Continued)

FOREIGN PATENT DOCUMENTS

EP 1 394 094 A2 3/2004
GB 2 418 154 A 3/2006

OTHER PUBLICATIONS

International Search Report, Jun. 5, 2012, from International Phase of the instant application.

*Primary Examiner* — Stephen Crow
*Assistant Examiner* — Garrett Atkinson
(74) *Attorney, Agent, or Firm* — Paul & Paul

(57) ABSTRACT

The invention relates to a physical exercise device which is to be entirely supported by the user and which is usable while walking or jogging. The device according to the invention is characterized in that it includes: for exercising the upper body, a belt (1), two side handles (2), and two resilient links (3), it being a given that each handle (2) is sized so as to contain, when the device is at rest, the entirety of each resilient link (3), the length and the resilient characteristics of which are such that the extension thereof out of the handle ensures the extension and 360° rotation in space of the upper limbs of the user; and, for exercising the lower body, a back roller (4) removably attached to the belt (1) and intended for rolling on a wall by bending and extending the lower limbs.

3 Claims, 3 Drawing Sheets

Figure 1:
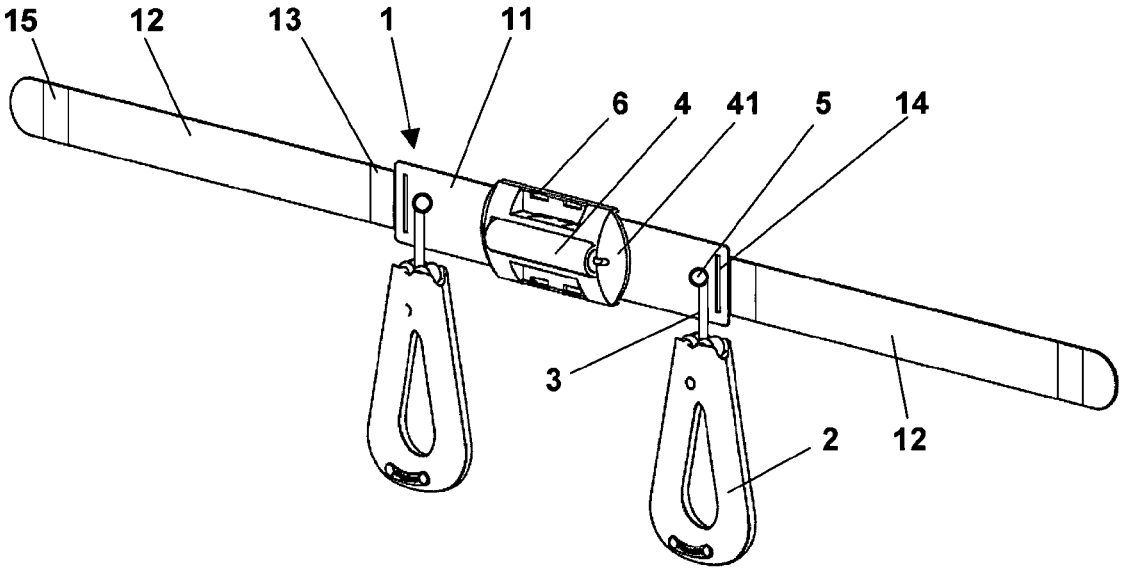

(51) Int. Cl.
*A63B 21/055* (2006.01)
*A63B 69/00* (2006.01)

(56) References Cited

U.S. PATENT DOCUMENTS

D271,051 S * 10/1983 McCoy ..... D21/679
4,441,707 A * 4/1984 Bosch ..... A63B 21/151 482/131
4,540,173 A * 9/1985 Hopkins, Jr. ..... A63B 21/0552 482/124
4,645,204 A * 2/1987 Berger ..... A63B 21/0004 482/123
4,961,573 A * 10/1990 Wehrell ..... A63B 21/0552 482/124
5,336,152 A 8/1994 Winslow
D350,795 S * 9/1994 Barbour ..... D21/692
5,358,461 A * 10/1994 Bailey, Jr. ..... A63B 21/0053 290/1 R
5,618,249 A * 4/1997 Marshall ..... A63B 21/153 482/115
5,733,231 A * 3/1998 Corn ..... A63B 21/025 482/120
5,876,310 A * 3/1999 Mackey ..... A63B 21/153 482/114
6,099,447 A * 8/2000 Ramsaroop ..... A63B 21/153 482/107
6,315,701 B1 11/2001 Shifferaw
7,086,992 B2 * 8/2006 Bowman ..... A63B 23/0222 482/142
7,207,931 B2 * 4/2007 Boland ..... A63B 21/0004 482/121
7,387,599 B1 * 6/2008 Hsu ..... A61H 15/0092 482/122
8,465,401 B1 * 6/2013 Ihli ..... A63B 21/00185 482/116
2003/0054924 A1 3/2003 Amore
2004/0053755 A1 3/2004 Wilkinson
2005/0085355 A1 4/2005 Berard
2005/0221965 A1 * 10/2005 Boland ..... A63B 21/0004 482/121
2008/0156922 A1 7/2008 Rabinowitz
2012/0322633 A1 * 12/2012 Holman ..... A63B 21/028 482/123

* cited by examiner

PHYSICAL EXERCISE DEVICE

FIELD OF THE INVENTION

The present invention relates to a physical exercise device, fully supported by the body of the user, designed to work the upper and/or lower limbs and, more particularly, adapted to outdoor activities as a complement to walking or jogging.

DESCRIPTION OF THE BACKGROUND TECHNOLOGIQUE

The known devices designed for physical exercises are of different types.

They generally comprise:

sophisticated devices placed directly on the floor; or elementary devices such as elastic or torsion bars.

The first are generally used indoor and the second can be used anywhere. Unfortunately, they are not always suitable for outdoor activities as a complement to walking or jogging.

SUMMARY OF THE INVENTION

The invention aims to implement a device of the second type with new and innovative features having the goal of meeting the needs of outdoor activities as a complement to walking or jogging.

The aforementioned device is essentially characterized, in the basic version of the invention that is designed to work more particularly the upper body and that comprises a belt and two handles coupled to the aforementioned belt by an elastic tie;

in that each handle is dimensioned to contain, when it is not actuated, i.e. at rest, the entirety of each elastic tie, which is guided and positioned in the interior thereof by a set pulleys;

and in that the length at rest and the elastic coefficient of each elastic tie are dimensioned to enable its out of handle extension along a length of between 3 to 5 times its length at rest in order to enable the extension and the 360° spatial rotation of the upper limbs of the user.

Such a design has the advantage:

- of being simple to implement and being reliable: absence of automatic roller, often the cause malfunctions;
- of no longer having hanging elastic;
- of having small bulk and low weight: essential for walking and jogging.

It is also characterized, in an optional additional implementation of the invention, in that is designed to work more specifically the lower body, and that it comprises a back roller removeably attached to the belt.

Such an implementation enables leaning on a vertical structure, particularly a wall, a lamp post, a door frame or a tree trunk, and rotatably moving the roller along it under the effect of the bending and extension of the lower limbs of the user.

It is also characterized, in an improved implementation of the invention, in that the handle is made of two parts:

- a first designed to house, when it is at rest, the entire elastic tie, which is guided and positioned in the interior of the latter by a set of pulleys;
- a second designed to constitute the means for ergonomic gripping and for rotating 360° around the aforementioned first part by means of an axle interconnecting them.

In order to enable the 360° rotation in space of the upper limbs without having to change the position of the hands on the handle and without loading, mainly in torsion, the elastic tie, the second part of the handle is penetrated by an extension of the axle coupling the two parts so as rotate 360° on itself. The friction of the elastic tie on the handle, the cause of its premature wear, is also greatly reduced.

It is also characterized in another improved implementation of the invention, in that the elastic tie is made in two separate parts, positioned side by side, guided by distinct pulleys, positioned side by side, each connected to the belt by means enabling their coupling and their uncoupling on demand of the user.

Such an implementation enables modification of the tension of the elastic in the course of use. For example, a part can constitute ⅓ of the total power and the other ⅔. There are thus available three possibilities of elastic tension, namely: ⅓ with one in action, ⅔ with each other in action and 3/3 with the two in action.

This is especially practical as the unused elastic part is entirely contained in the handle thus eliminating any inconvenience or any disassembly of it as a whole in order to meet this requirement.

It is also characterized, in an advantageous implementation of the invention, in that the belt is constituted by a central part, made of flexible material, coupled to two symmetrical means each designed to hold the free end of the corresponding elastic tie, and two identical lateral parts, made of flexible material, provided at one end with means designed to provide their attachment to the symmetrical openings fitted on the central part and provided, at the other end, with means designed to provide the adjustable connection, in particular of the self-sticking type, of the aforementioned free ends in order to hold the belt to the waist of the user.

The device according to the invention has the advantage of being simple to implement and having a small bulk and low weight.

It enables working the upper and lower part of the body equally, by performing free gymnastic movements while walking or running and without being inconvenienced by any traditional gym equipment.

When not actuated, the device according to the invention present no inconvenience because the handles are in contact with the belt and the roller attached to the rear. It can even be removed because it is removable.

Moreover, it is fully supported by the body of the user because of its attachment to his waist.

PRESENTATION OF FIGURES

The features and advantages of the invention will appear more clearly upon reading the detailed description that follows of at least one of its preferred implementation modes, given by way of non-limiting example and shown in the accompanying drawings.

Figure 2:
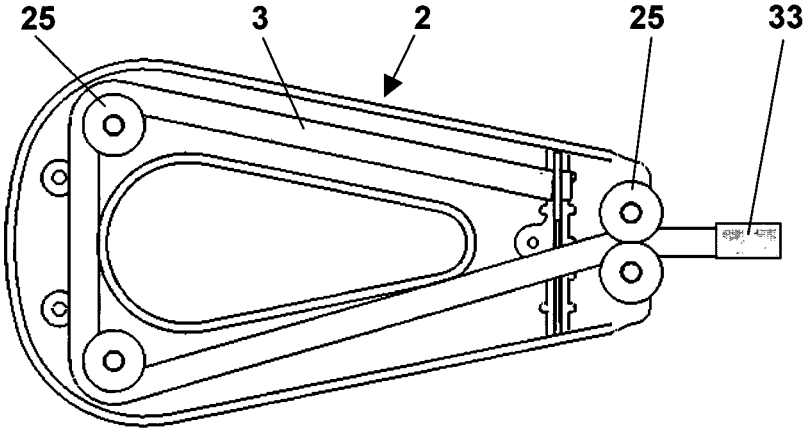
Figure 3:
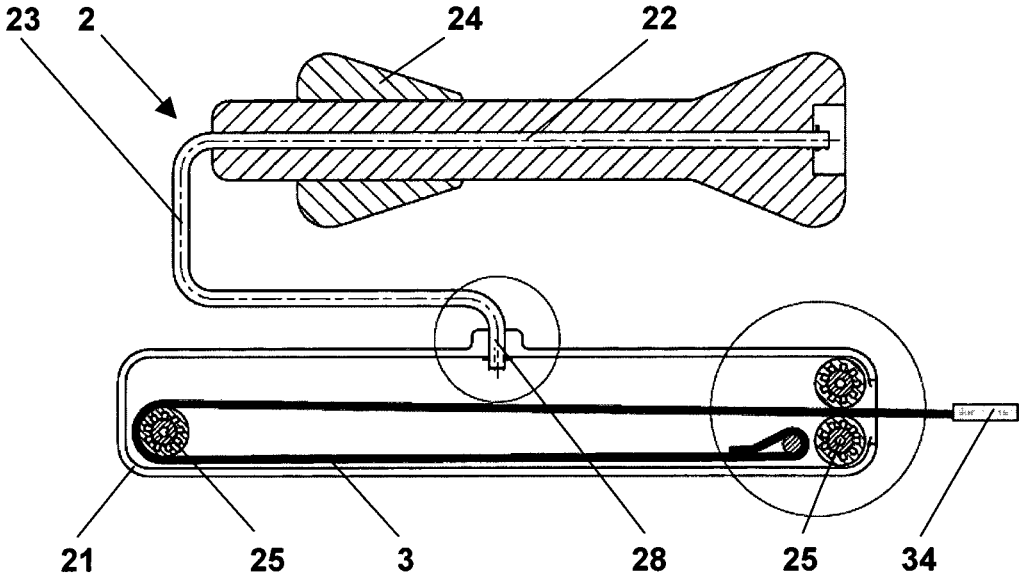
Figure 4:
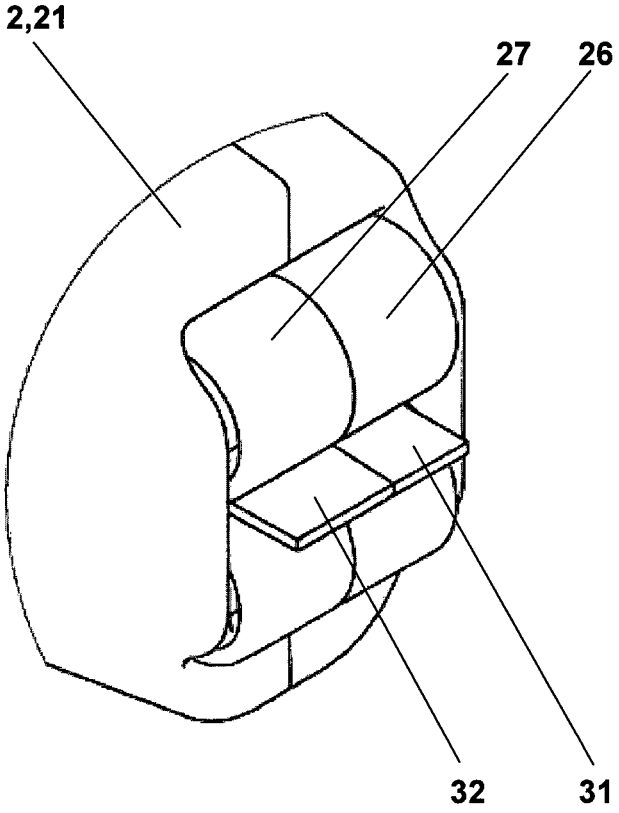

In these drawings:

FIG. 1 is a perspective view of the "belt, handles and roller" assembly according to the invention;

FIG. 2 is an interior view of a handle showing the elastic tie in rest position and its means of guiding and positioning in the interior thereof, FIG. 3 is an interior view of a handle made in two parts rotatable between themselves, the first designed to house the elastic tie in the rest position and its means of guiding and positioning in the interior thereof, the second designed to constitute the ergonomic gripping means;

FIG. 4 is a perspective view of the end of the housing of the elastic, emphasizing the elastic tie made of two parts.

DETAILED DESCRIPTION OF THE INVENTION

The device shown comprises a belt (1) and two handles (2) connected to the aforementioned belt by an elastic tie (3).

Each handle (2) is dimensioned to contain, when it is not actuated, i.e. at rest, the entirety of each elastic tie (3), which is guided and positioned in the interior thereof by a set pulleys (25).

The length at rest and the elastic coefficient of each elastic tie (3) are dimensioned to enable its out of handle extension along a length of between 3 to 5 times its rest length in order to enable the extension and the 360° spatial rotation of the upper limbs of the user.

The device comprises a back roller (4) removably attached to the belt (1).

Each handle (2) can be made in two parts:

a first (21) designed to house, when it is at rest, the entire elastic tie (3), which is guided and positioned in the interior of the latter by a set of pulleys (25);

a second (22) designed to constitute the ergonomic gripping means and to rotate 360° around the aforementioned first part by means of an axle (23) interconnecting them.

The second part (22) of the handle (2) can be penetrated by an extension of the axle (23) so as to rotate 360° on itself.

The aforementioned axle can be connected to the first part (21) at a central point (28).

The second part (22) of the handle (2) can comprise a member (24), slidable thereon, designed to be positioned depending on the width of the hand of the user.

The elastic tie (3) can be made in two separate parts (31) and (32), positioned side by side, guided by distinct pulleys (26) and (27), positioned side by side, each connected to the belt by a means (5) enabling their coupling and their uncoupling on demand of the user.

The elastic tie (3) of FIG. 2 comprises an end (33) and that (3) of FIG. 3 comprises an end (34) that are designed to be attached to the belt (1).

The belt (1) can be constituted by a central part (11), made of flexible material, coupled to two symmetrical means (5) each designed to hold the free end of the corresponding elastic tie (3), and by two identical lateral parts (12), made of flexible material, provided at one end with means (13) designed to provide their attachment to symmetrical openings (14) fitted on the central part (11) and provided, at the other end, with means (15) designed to provide the adjustable connection of the aforementioned free ends in order to hold the belt (1) to the waist of the user.

The central part (11) of the belt (1) can be made of PVC having 1.5 mm thickness. The identical side parts (12) of the belt (1) can be made of fabric. The back roller (4) is mounted, freely in rotation, on a support (41) that is removably attached to the attachment means (6) of the central part (11) of the belt (1).

It could also be non-removably mounted on the belt.

It could also not be mounted on the belt at all, in a simplified implementation of the invention designed work only the upper body.

Of course, the person of ordinary skill in the art will be able to make the invention as described and shown by applying and adapting known means without it being necessary to describe or represent them.

He will also be able to foresee other variations in the forms and the materials used, without thereby departing from the scope of the invention that is determined by the terms of the claims.

The invention claimed is:

1. A device for exercise, fully supported by a body of a user, comprising, in order to work the upper body:

a belt provided with an adjustable attachment;

a first elastic tie;

a first side-handle coupled to the belt via the first elastic tie, the first side-handle including a first plurality of pulleys, the first side-handle being dimensioned to contain, when the first side-handle is not actuated, most of the first elastic tie, the first plurality of pulleys acting to guide and position the first elastic tie in an interior of the first side-handle;

a second elastic tie; and a second side-handle coupled to the belt via the second elastic tie, the second side-handle including a second plurality of pulleys, the second side-handle being dimensioned to contain, when the second side-handle is not actuated, most of the second elastic tie, the second plurality of pulleys acting to guide and position the second elastic tie in an interior of the second side-handle, wherein a length at rest and an elastic coefficient of the first elastic tie are dimensioned to enable an out of handle extension of the first elastic tie along a length of between 3 to 5 times a rest length of the first elastic tie in order to enable an extension and a 360° spatial rotation of an upper limb of the user.

2. A device according to claim 1, characterized in that the first elastic tie is made in two separate tie parts, positioned side by side, the first tie part being guided by a first pulley of the first plurality of pulleys, the second tie part being guided by a second pulley of the first plurality of pulleys, the first pulley being positioned on a side of the second pulley, each of the first and second pulleys configured to be coupled to or uncoupled from the belt on demand of the user.

3. A device according to claim 1 wherein the first side-handle is dimensioned to contain, when the first side-handle is not actuated, the entirety of the first elastic tie.

* * * * *